US008733861B1

(12) United States Patent
Mann

(10) Patent No.: US 8,733,861 B1
(45) Date of Patent: May 27, 2014

(54) COOPERATING CABINETRY HINGE ARRANGEMENT FOR DOORS OR PANELS

(76) Inventor: Robert W. Mann, Tucson, AZ (US)

( * ) Notice: Subject to any disclaimer, the term of this patent is extended or adjusted under 35 U.S.C. 154(b) by 0 days.

(21) Appl. No.: 13/286,931

(22) Filed: Nov. 1, 2011

(51) Int. Cl.
*A47B 88/06* (2006.01)

(52) U.S. Cl.
USPC ..... 312/294

(58) Field of Classification Search
USPC ..... 312/294, 295, 310, 311; 5/2.1, 3, 4, 5, 5/6, 7
See application file for complete search history.

(56) References Cited

U.S. PATENT DOCUMENTS

| | | | | |
|---|---|---|---|---|
| 324,775 | A * | 8/1885 | Jones | 5/2.1 |
| 2,671,230 | A * | 3/1954 | Potter | 5/141 |
| 2,814,545 | A * | 11/1957 | Cornish | 312/271 |
| 4,221,442 | A * | 9/1980 | Harangozo | 312/294 |
| 4,616,370 | A * | 10/1986 | Keenan et al. | 5/2.1 |
| 7,069,605 | B2 * | 7/2006 | Harvey, III | 5/2.1 |
| 7,487,564 | B2 * | 2/2009 | Miller | 5/716 |
| 7,979,930 | B2 * | 7/2011 | Miller | 5/2.1 |
| 2006/0021135 | A1 * | 2/2006 | Harvey | 5/93.2 |
| 2008/0163421 | A1 * | 7/2008 | Stonier | 5/2.1 |

* cited by examiner

*Primary Examiner* — Jerry Redman

(74) *Attorney, Agent, or Firm* — Quarles & Brady LLP; Gavin J. Milczarek-Desai

(57) ABSTRACT

A cooperating hinge arrangement on a door or panel that includes a first hinge coupled with a first area of the door or panel and a second hinge coupled with a second area of the door or panel. The first and second areas of the door or panel meet at a miter joint such that opening of the first area simultaneously opens the second area of the door or panel.

13 Claims, 3 Drawing Sheets

COOPERATING CABINETRY HINGE ARRANGEMENT FOR DOORS OR PANELS

BACKGROUND OF THE INVENTION

1. Field of the Invention

The invention relates generally to cabinetry hinge arrangements that provides unique structural, aesthetic, and operational features and more particularly to arrangements that are especially useful for large cabinets such as wall beds.

2. Description of the Related Art

Furniture and functional accessories, such as cabinets, pull-down tables and beds, and the like, typically contain a pair of pivot or other type of hinges about which a door or a panel is opened. While such hinges may be of many different varieties, they all essentially provide a means for opening a door or panel at least ninety degrees from a closed position.

However, it is desirable in some instances to provide a hinge arrangement that, while allowing a door or panel to be opened to a desired position, cooperates to simultaneously open a second area of the door or panel.

SUMMARY OF THE INVENTION

Embodiments disclosed herein relate to a cooperating hinge arrangement on a door or panel that includes a first hinge coupled with a first area of the door or panel and a second hinge coupled with a second area of the door or panel. The first area contacts the second area at a miter joint such that opening of the first area simultaneously opens (i.e., cooperates with) the second area of the door or panel.

The miter joint of various embodiments includes a strip portion from the first area and a strip portion from the second area, with both strip portions being beveled at about forty-five degrees. Thus, only the strip portions and not the entire interface between the first and second areas need be in contact during cooperation.

Various other purposes and embodiments of the invention are disclosed in the specification that follows. However, such description discloses only some of the various ways in which the invention may be practiced.

DETAILED DESCRIPTION OF THE PREFERRED EMBODIMENTS

Figure 1:
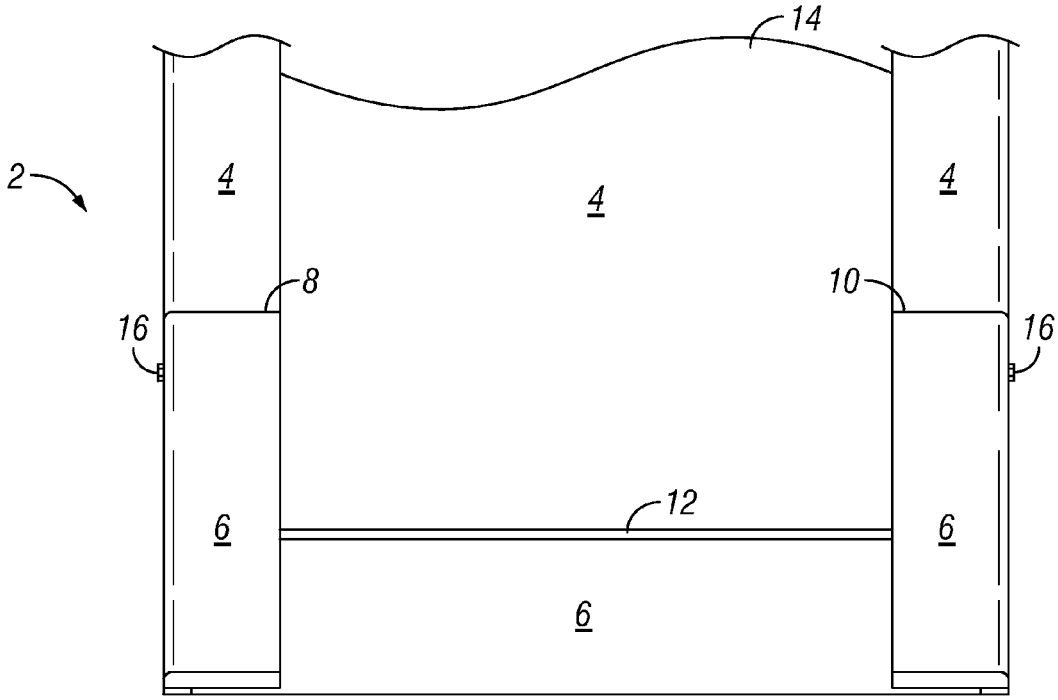
FIG. 1 is a simplified front elevational view of an embodiment of a cabinet door or panel having a first area and a second area and that includes a cooperating hinge arrangement.
Figure 5:
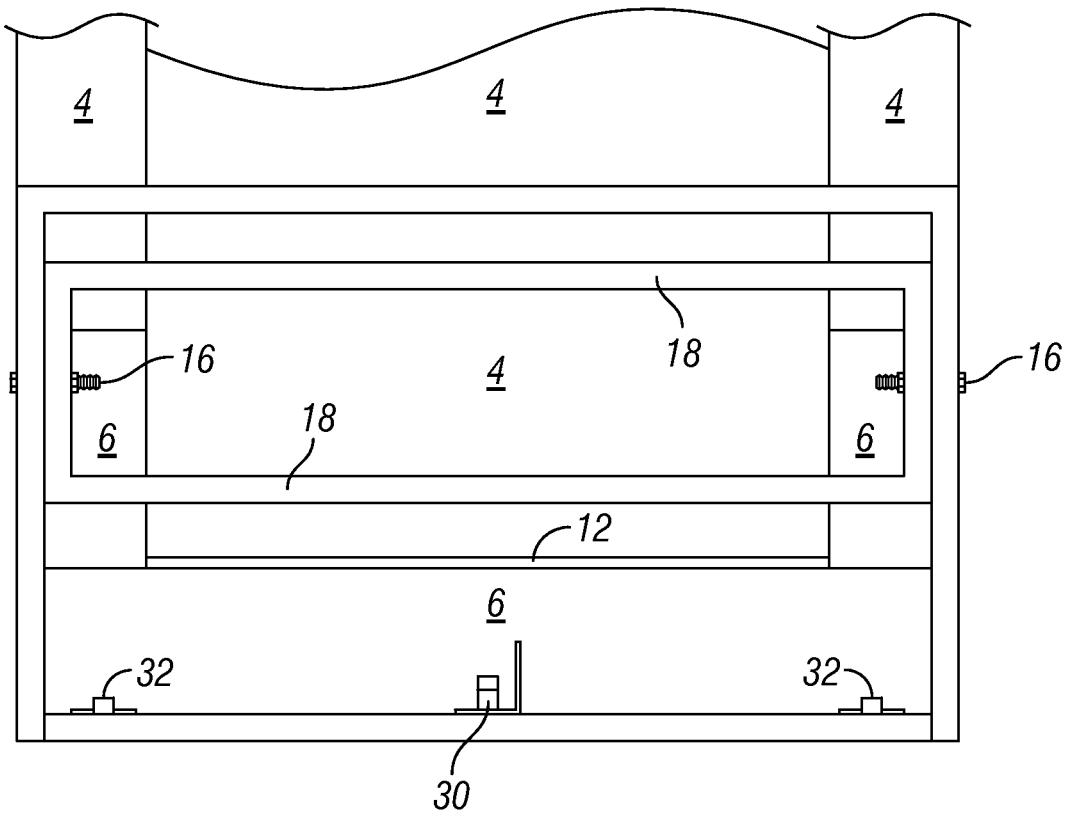
FIG. 5 is a rear elevational view of the embodiment in FIG. 1.

FIGS. 1 and 5 illustrate a simplified front and rear elevational view, respectively, of an embodiment of a cabinet door or panel 2 having a first area 4 and a second area 6. The first and second areas of the door or panel 2 have an interface defined by a pair of miter joints 8 and 10 and a spaced section 12. The miter joints 8 and 10 preferably are beveled at about forty-five degrees and form areas of contact between areas 4 and 6, while spaced section 12 provides clearance for the opening of areas 4 and 6 as further described below.

Figure 2:
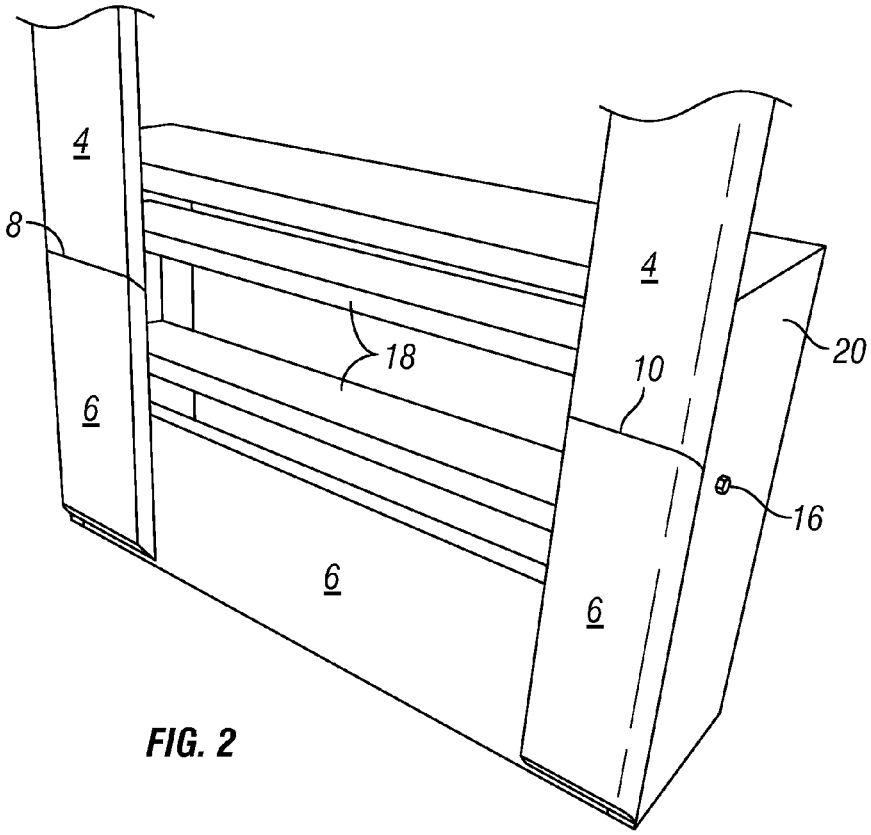
FIG. 2 illustrates in perspective view the embodiment of FIG. 1, with the central portion of the door or panel of the first area removed to better show the hinge arrangement.
Figure 3:
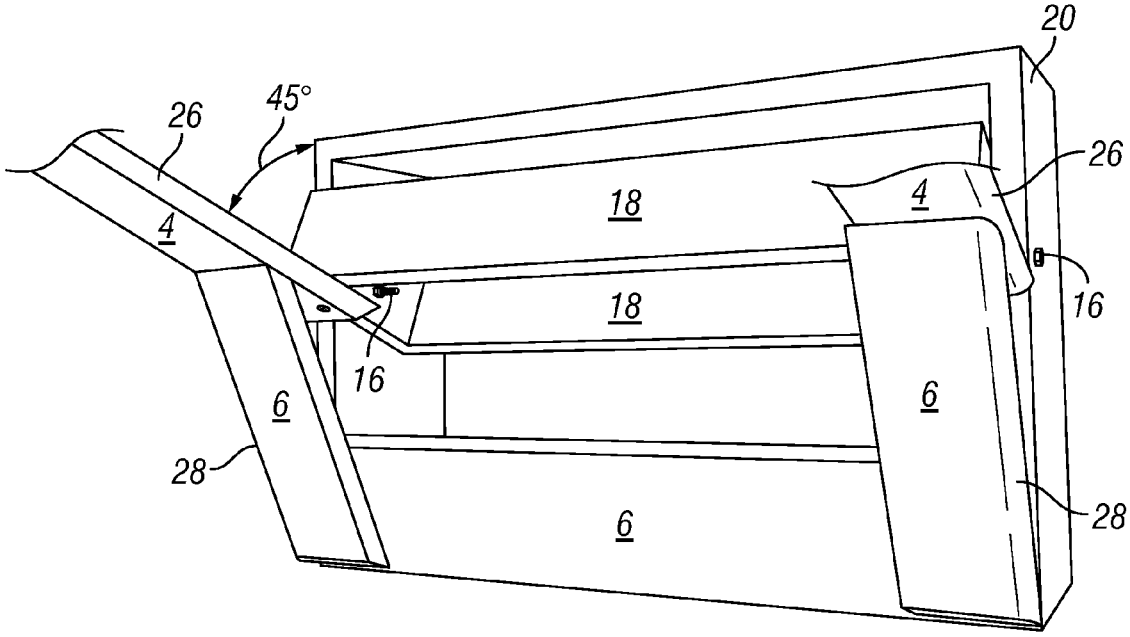
FIG. 3 is a front perspective view of the embodiment of FIG. 2 in which opening of the first area of the door or panel about a pair of pivot hinges actuates the opening of the second area.

FIGS. 2 and 3 illustrate in perspective view the embodiment of FIG. 1, with the central portion 14 of the door or panel of area 4 removed to better show the hinge arrangement. A first hinge, which in this case includes a pair of pivot hinges 16 (see also FIG. 1), are coupled with the first area 4 through box 18 inside of cabinet 20. Since the hinge arrangement disclosed herein can be used in a variety of applications, such as wall beds and fold-out tables, a cabinet is only referenced by way of illustration.

While central portion 14 of the door or panel of area 4 has been removed, it will be understood that the central portion would be attached to box 18 and/or to the remaining slat portions of area 4 but would not be attached to any part of area 6. Also, it is possible to have just a single hinge coupled to area 4 if the hinge is of suitable strength, or, for example, the door or panel is lightweight or part of a small cabinet or other arrangement.

Initially, both area 4 and 6 of door or panel 2 are in the same vertical plane or "closed" position. As area 4 of the door or panel is opened, for example to forty-five degrees as shown in FIG. 3, miter joints 8 and 10 also open such that strip 26 of area 4 cooperate with strip 28 of area 6. In other words, opening area 4 simultaneously opens area 6 as the strips 28 slideably engage strips 26 such that strips 28 are urged downwardly along with the remaining portion of area 6.

Figure 4:
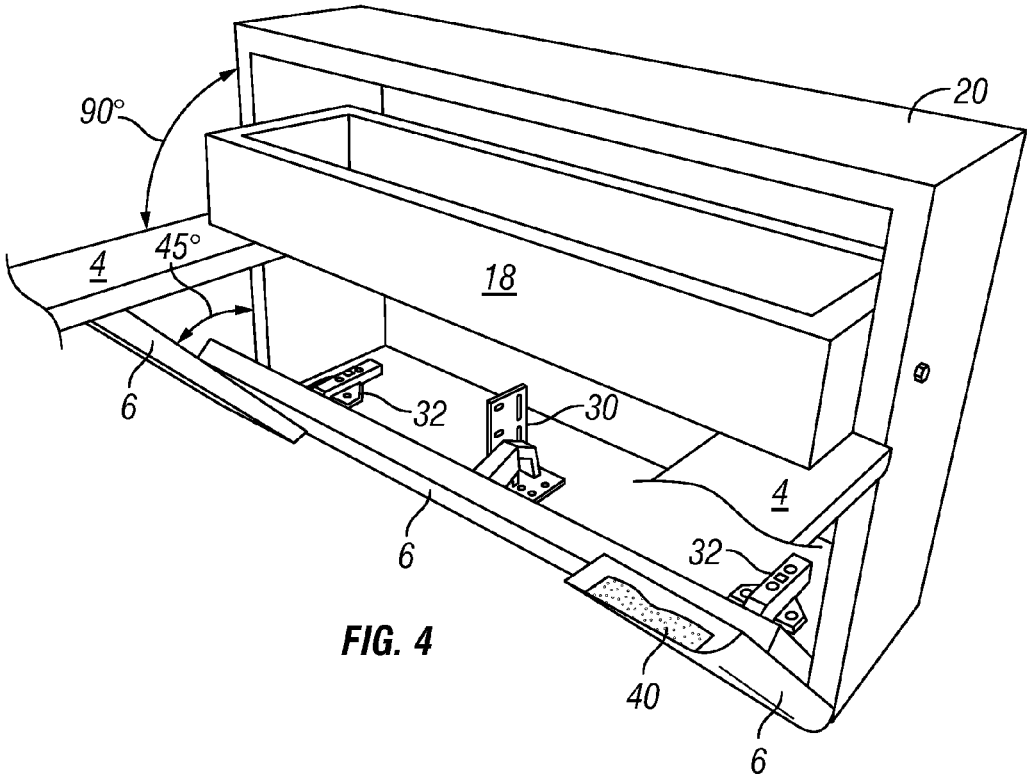
FIG. 4 is a front perspective, partial cut-away view of the more fully opened embodiment in FIG. 3, in which a second hinge is shown in cooperating arrangement with the first pair of pivot hinges.

FIG. 4 shows in a front perspective, partially cut-away view the more fully opened embodiment illustrated in FIG. 3. A second hinge 30 is coupled with the second area 6 of the door or panel, with the placement of additional hinges 32 depending on the application. Since the first area 4 contacts the second area 6 at miter joints 8 and 10 such that opening of area 4 simultaneously opens area 6, a layer of material 40, such as felt, may be disposed at the interface defined by miter joints 8 and 10 to ease slideability and reduce or eliminate scratching.

While hinge 30 may allow second area 6 to open to an angle of at least ninety degrees, preferably hinge 30 is made (or is adjustable) such that it limits the second area 6 angle of opening to less than the opening angle of the first area 4. For example, limiting the angle of opening of area 6 to about forty-five degrees provides a buttressing effect as shown in FIG. 4 and keeps area 6 above horizontal level such that, for example, it is less likely one will stub a toe if cabinet 20 is on the ground.

In some applications, the second hinge 30 is biased to a closed position through a spring or other biasing means. Thus, when area 4 is moved from an open position (e.g., horizontal) to a closed position (e.g., vertical), area 6 is urged towards a closed position to the extent allowed by the engagement between strips 26 and 28.

As will be readily apparent from the structural arrangement disclosed above and in the figures, the second area 6 is openable independently of first area 4 but cannot attain a completely closed position unless the first area is completely closed. Thus, second area 6 may be opened without opening the first area 4, thereby allowing access to hinge 30 for adjustment or to items stored in the space available around hinge 30.

Various changes in the details and components that have been described may be made by those skilled in the art within the principles and scope of the embodiments herein described in the specification and defined in the appended claims.

Therefore, while the present embodiments have been shown and described herein in what is believed to be the most practical and preferred embodiments, it is recognized that departures can be made therefrom, such that the embodiments are not to be limited to the details disclosed herein but are to be accorded the full scope of the claims so as to embrace any and all equivalents.

What is claimed is:

1. A cooperating hinge arrangement on a door or panel, comprising:

a first hinge coupled with a first area of said door or panel, said first area further defined as a first pair of strips spaced apart and connected to said first area; and a second hinge coupled with a second area of said door or panel, said second area further defined as a second pair of strips spaced apart and connected to said second area, said second pair of strips and said second area located below said first pair of strips and said first area, wherein said first area is separated from said second area by a spaced section and said first area contacts said second area at a pair of miter joints located at an interface of said first and second pair of strips such that opening of said first area simultaneously opens said second area of said door or panel.

2. The hinge arrangement of claim 1, wherein said pair of miter joints are beveled at about forty-five degrees.

3. The hinge arrangement of claim 1, wherein said first hinge comprises a pair of pivot hinges.

4. The hinge arrangement of claim 1, wherein said second hinge is biased to a closed position.

5. The hinge arrangement of claim 1, wherein a layer of material is disposed at an interface of each miter joint.

6. The hinge arrangement of claim 1, wherein said second hinge limits said second area to an angle of opening that is less than an opening angle of the first area.

7. The hinge arrangement of claim 1, where said second area is openable independently of said first area but cannot attain a completely closed position unless said first area is completely closed.

8. A cooperating hinge arrangement on a door or panel, comprising:

at least a pair of hinges coupled with a first area of said door or panel, said first area further defined as a first pair of strips spaced apart and connected to said first area; and a second hinge coupled with a second area of said door or panel, said second area further defined as a second pair of strips spaced apart and connected to said second area, said second pair of strips and said second area located below said first pair of strips and said first area, wherein said first area is separated from said second area by a spaced section, said first pair of hinges are adapted to provide an angle of opening of said first area of up to ninety degrees, and said first area contacts said second area at a pair of miter joints located at an interface of said first and second pair of strips such that opening of said first area simultaneously opens said second area of said door or panel.

9. The hinge arrangement of claim 8, wherein said pair of miter joints are beveled at about forty-five degrees.

10. The hinge arrangement of claim 8, wherein said second hinge is biased to a closed position.

11. The hinge arrangement of claim 8, wherein a layer of material is disposed at an interface of the pair of miter joints.

12. The hinge arrangement of claim 8, wherein said second hinge limits said second area to an angle of opening that is less than an opening angle of the first area.

13. The hinge arrangement of claim 8, where said second area is openable independently of said first area but cannot attain a completely closed position unless said first area is completely closed.

* * * * *